US006014155A

United States Patent [19]

Mammino et al.

[11] Patent Number: 6,014,155

[45] Date of Patent: Jan. 11, 2000

[54] PRINTING MACHINE WITH A HEATED IMAGING MEMBER

[75] Inventors: Joseph Mammino, Penfield; Santokh S. Badesha, Pittsford, both of N.Y.

[73] Assignee: Xerox Corporation, Stamford, Conn.

[21] Appl. No.: 09/071,180

[22] Filed: May 1, 1998

[51] Int. Cl.[7] ..... B41J 2/41; G03G 5/02

[52] U.S. Cl. ..... 347/120; 347/153; 347/155; 399/296

[58] Field of Search ..... 399/96, 159, 296, 399/307; 347/112, 115, 120, 153, 154–6

[56] References Cited

U.S. PATENT DOCUMENTS

| | | | |
|---|---|---|---|
| Re. 28,693 | 1/1976 | Doi et al. | 347/153 |
| 4,777,087 | 10/1988 | Heeks et al. | 428/321.1 |
| 5,096,796 | 3/1992 | Mammino et al. | 430/67 |
| 5,103,263 | 4/1992 | Moore et al. | 399/163 |
| 5,198,842 | 3/1993 | Fujino et al. | 347/120 |
| 5,266,431 | 11/1993 | Mammino et al. | 430/96 |
| 5,338,587 | 8/1994 | Mammino et al. | 428/35.7 |
| 5,493,373 | 2/1996 | Gundlach et al. | 355/279 |
| 5,608,508 | 3/1997 | Kumagai et al. | 399/333 |

*Primary Examiner*—Joan Pendegrass
*Attorney, Agent, or Firm*—Zosan S. Soong

[57] ABSTRACT

A printing machine composed of: (a) an electrographic imaging member including a substrate layer and a charge accepting layer selected from the group consisting of a silicone elastomer and a grafted elastomer composed of a polyorganosiloxane bonded to a fluoroelastomer; (b) latent image generating apparatus for recording an electrostatic latent image on the imaging member; (c) developer apparatus for depositing marking material on the imaging member to produce a marking material image; (d) a heating device for heating the imaging member so as to form a tackified marking material image thereon; and (e) transfer apparatus for transfering the tackified marking material image from the imaging member to a recording sheet

13 Claims, 2 Drawing Sheets

PRINTING MACHINE WITH A HEATED IMAGING MEMBER

FIELD OF THE INVENTION

This invention relates to a printing machine containing an electrographic imaging member. The term printing machine includes copiers, duplicators, and printers.

BACKGROUND OF THE INVENTION

In electrography or ionography, an electrostatic latent image is formed on a dielectric imaging surface of an imaging layer (electroreceptor) by various techniques such as by ion stream (ionography), stylus, shaped electrode, and the like. Development of the electrostatic latent image may be effected by contacting the imaging surface with electrostatically attractable marking or toner particles whereby the particles deposit on the imaging surface in conformance to the latent image. The deposited particles may be transferred to a receiving member (such as paper) and the imaging surface may be cleaned and cycled through additional imaging and development cycles.

In addition, it is often important that electrostatographic imaging members be compatible with various imaging systems. Modern copiers and printers employ various development systems utilizing liquid or dry developers for producing color or black and white images. It is desirable to create an imaging member which will function in as many imaging systems as possible because not all existing imaging members function equally effectively in all environments. Ideally, an imaging member would be created to function equally effectively in liquid or dry developers and be useful in color or black or white copying systems.

Ionography is, in some respects, similar to the more familiar form of imaging used in electrophotography. However, the two types of imaging are fundamentally different. In electrophotography, an electrophotographic member containing a photoconductive insulating layer on a conductive layer is imaged by first uniformly electrostatically charging its surface. The member is then exposed to a pattern of activating electromagnetic radiation such as light. The electrophotographic member is insulating in the dark and conductive in light. The radiation therefore selectively dissipates the charge in the illuminated areas of the photoconductive insulating layer while leaving behind an electrostatic latent image in the non-illuminated areas. Thus, charge is permitted to flow through the imaging member. The electrostatic latent image may then be developed to form a visible image by depositing finely divided electroscopic marking particles on the surface of the photoconductive insulating layer. The resulting visible image may then be transferred from the electrophotographic member to a support such as paper. This imaging process may be repeated many times with reusable photoconductive insulating layers.

Ionographic imaging members differ in many respects from the above-described and other electrophotographic imaging members. The imaging member of ionographic devices is electrically insulating so that charge applied thereto does not disappear prior to development. Charge flow through the imaging member is undesirable since charge may become trapped, resulting in a failure of the device. Ionographic receivers possess negligible, if any, photosensitivity. The absence of photosensitivity provides considerable advantages in ionographic applications. For example, the electroreceptor enclosure does not have to be completely impermeable to light, and radiant fusing can be used without having to shield the receptor from stray radiation. Also, the level of charge decay (the loss of surface potential due to charge redistribution or opposite charge recombination) in these ionographic receivers is characteristically low, thus providing a constant voltage profile on the receiver surface over extended time periods.

However, ionographic imaging members generally suffer from a number of disadvantages. In an ionographic machine, the electroreceptor comes into contact with development and cleaning sub-systems. Also, paper contacts the surface of the electroreceptor in the transfer zone. Thus, an electroreceptor material which has good electrical properties for ionographic applications, Le., electrically insulating, may be triboelectrically incompatible with the sub-systems of the ionographic machine. For example, a particularly good electroreceptor dielectric material may be incompatible with toner contact because of high triboelectric charging. This incompatibility leads to, among other problems, cleaning failures because of the poor toner release properties of the dielectric material.

A further problem with many ionographic imaging members involves high charge decay and charge trapping. Materials having a high dielectric constant and good toner release properties may suffer from high surface charge decay and charge trapping. For example, materials having a high dielectric constant, such as polyvinyl fluoride, have high charge decay rates and bulk charge trapping.

It is also desirable for exposed surfaces of a dielectric receiver to have good wear, abrasion, scratch, and chemical resistance properties. Organic film forming resins used in the dielectric imaging layer are subject to wear, abrasions, scratches, and chemical attack by liquid developers which adversely affect the response of the dielectric receiver.

It is also desirable in certain applications involving liquid developers to condition the developed toner image by removing the excess liquid carrier fluid associated with the developed image so as to increase toner solids. An electrographic imaging member which retains an image charge when heated electrostatically holds the toner in position while the toner carrier fluid is removed for example by evaporation thereby improving image resolution.

The above and other problems limit the use of various materials in ionographic charge receivers. The problems are further complicated in that there are very few materials with high dielectric constants which have the desirable properties for ionographic imaging. Thus, the present invention addresses the problems described herein.

Conventional printing machines and electrographic imaging members are disclosed in Gundlach et al., U.S. Pat. No. 5,493,373, Mammino et al., U.S. Pat. No. 5,338,587, Mammino et al. U.S. Pat. No. 5,096,796, and Mammino et al., U.S. Pat. No. 5,266,431.

An illustrative fusing system is disclosed in Heeks et al., U.S. Pat. No. 4,777,087.

SUMMARY OF THE INVENTION

The present invention is accomplished in embodiments by providing a printing machine comprising:

(a) an electrographic imaging member including a substrate layer and a charge accepting layer selected from the group consisting of a silicone elastomer and a grafted elastomer composed of a polyorganosiloxane bonded to a fluoroelastomer;

(b) latent image generating apparatus for recording an electrostatic latent image on the imaging member;

(c) developer apparatus for depositing marking material on the imaging member to produce a marking material image;

(d) a heating device for heating the imaging member so as to form a tackified marking material image thereon; and (e) transfer apparatus for transfering the tackified marking material image from the imaging member to a recording sheet.

DETAILED DESCRIPTION

Figure 1:
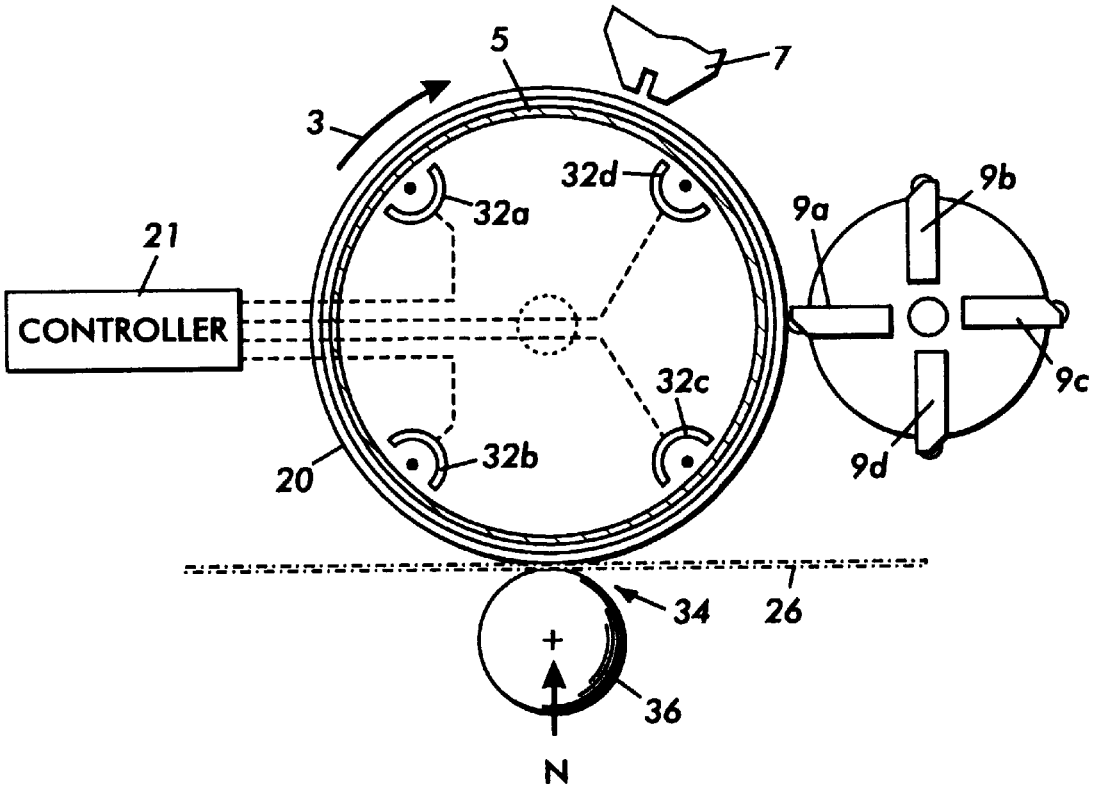
FIG. 1 is a simplified representation of the various processing stages employed in a preferred embodiment of the present printing machine.
Figure 2:
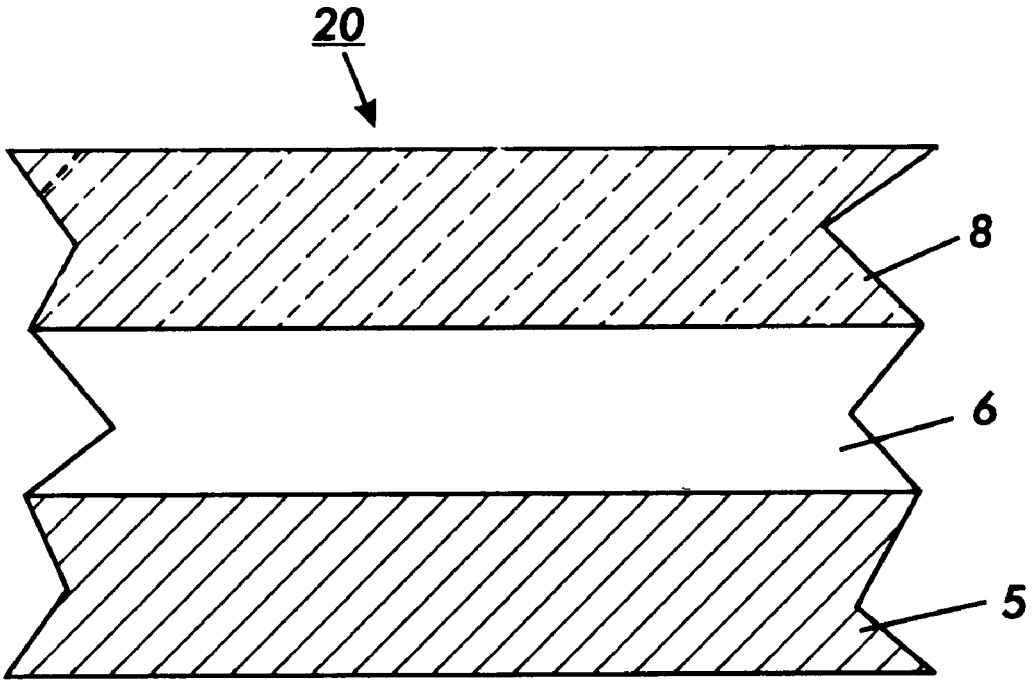
FIG. 2 is an illustration in cross-section of a preferred electrographic imaging member.

The present electrographic imaging member includes a substrate layer and a charge accepting layer selected from the group consisting of a silicone elastomer and a grafted elastomer composed of a polyorganosiloxane bonded to a fluoroelastomer.

A preferred group of silicone elastomers include the curable silicone elastomers such as the commercially available condensation curable and addition curable polyorganosiloxane materials. The typical curable polyorganosiloxanes are represented by the formula:

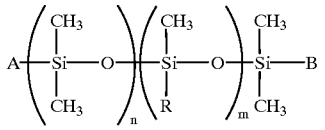

wherein R is hydrogen or substituted or unsubstituted alkyl alkenyl or aryl having less than 19 carbon atoms, each of A and B may be any of methyl, hydroxy or vinyl groups and $$0<m/n<1$$

and $$m+n>350.$$

The condensation curable polyorganosiloxanes are typically silanol terminated polydimethylsiloxanes such as:

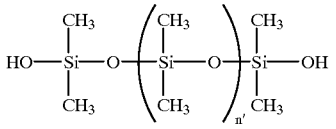

where n' is 350 to 2700. The terminating silanol groups render the materials susceptible to condensation under acid or mild basic conditions and are produced by kinetically controlled hydrolysis of chlorosilanes. Room temperature vulcanizable (RTV's) systems are formulated from these silanol terminated polymers with a molecular weight of 26,000 to 200,000 and they may be crosslinked with small quantities of multifunctional silanes which condense with the silanol group. Crosslinking agents which are suitable include esters of orthosilicic acid, esters of polysilic acid and alkyl trialkoxy silanes. Specific examples of suitable crosslinking agents for the condensation cured materials include tetramethylorthosilicate, tetraethylorthosilicate, 2-methyoxyethylsilicate, tetrahydrofurfurylsilicate, ethylpolysilicate and butylpolysilicate, etc. During the crosslinking reaction, an alcohol is typically split out leading to a crosslinked network We particularly prefer to use condensed tetraethylorthosilicate as a crosslinking agent. The amount of the crosslinking agent employed is not critical as long as a sufficient amount is used to completely crosslink the active end groups on the disilanol polymer. In this respect, the amount of crosslinking agent required depends on the number average molecular weight of the disilanol polymer employed. With higher average molecular weight polymers there are fewer active end groups present and thus a lesser amount of crosslinking agent is required and vice versa Generally, with the preferred alpha omega hydroxy polydimethyl siloxane having a number average molecular weight of between about 26,000 to about 100,000 we have found that between 6 to 20 parts by weight of condensed tetraethylorthosilicate per 100 parts by weight of disilanol polymer to be suitable.

A particularly preferred embodiment of the present invention relates to a liquid addition cured polyorganosiloxanes achieved by using siloxanes containing vinyl groups at the chain ends and/or scattered randomly along the chain along with siloxanes having anything more than two silicon hydrogen bonds per molecule. Typically these materials are cured at temperatures of from about 100° C. to 250° C.

Typical materials are represented by the formula:

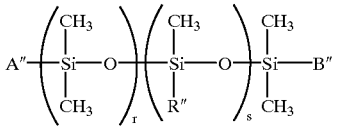

where A", B" and R" are methyl or vinyl provided the vinyl functionality is at least 2, $$0<s/r<1,\ 350<r+s<2700.$$

By the phrase the functionality is at least 2 it is meant that in the formula for each molecule there must be at least a total of 2 vinyl groups in the A", B" and any of the several R" sites within the formula In the presence of suitable catalysts such as solutions or complexes of chloroplatinic acid or other platinum compounds in alcohols, ethers or divinylsiloxanes reaction occurs with temperatures of 100° C. to 250° C. with the addition of polyfunctional silicon hydride to the unsaturated groups in the polysiloxane chain. Typical hydride crosslinkers are methylhydrodimethylsiloxane copolymers with about 15–70 percent methylhydrogen. Elastomers so produced exhibit increased toughness, tensile strength and dimensional stability. Typically, these materials comprise the addition of two separate parts of the formulation, part A containing the vinyl terminated polyorganosiloxane, the catalyst and the filler, part B containing the same or another vinyl terminated polyorganosiloxane, the crosslink moiety such as a hydride functional silane and the same or additional filler where part A and part B are normally in a ratio of one to one. During the additional curing operation the material is crosslinked via the equation $$\equiv SiH+CH_2{=}CHSi\equiv \rightarrow \equiv SiCH_2CH_2Si\equiv$$

and since hydrogen is added across the double bond no offensive byproduct such as acids or alcohols is obtained.

Accordingly and by way of example in the above formula for the polyorganosiloxane having substituents A, B, and R, typical substituted alkyl groups include alkoxy and substituted alkoxy, chloropropyl, trifluoropropyl, mercaptopropyl, carboxypropyl, aminopropyl and cyanopropyl. Typical substituted alkoxy substituents include glycidoxypropyl, and methacryloxypropyl. Typical alkenyl substituents include vinyl and propenyl, while substituted alkenyl include halogen substituted materials such as chlorovinyl, and bromopropenyl. Typical aryl or substituted groups include phenyl and chlorophenyl. Hydrogen, hydroxy, ethoxy and vinyl are preferred because of superior crosslinkability. Methyl, trifluoropropyl and phenyl are preferred in providing superior solvent resistance, higher temperature stability and surface lubricity. The ratio of $$m/n$$

being between 0 and 1 identifies the polyorganosiloxane as a copolymer and the sum of m+n being greater than 350 identifies it as an elastomeric material.

The crosslinking agent used in the composition is for the purpose of obtaining a material with sufficient crosslink density to obtain maximum strength and fatigue resistance. The amount of crosslinking agent employed is not critical as long as the amount used is sufficient to sufficiently crosslink the active groups of the polymer used.

Crosslinking catalysts are well known in the art and include among others, stanneous octoate, dibutyltindilaurate, dibutyltindiacetate and dibutyltindicaproate for the condensation cured polyorganosiloxanes. The amount of catalysts employed is not critical, however, too small an amount of catalyst may lead to a very small reaction which is impractical On the other hand, excessive amounts of catalysts may cause a breakdown of the crosslinked polymer network at high temperatures to yield a less crosslinked and weaker material, this adversely affecting the mechanical and thermal properties of the cured material.

The grafted elastomer is composed of a polyorganosiloxane bonded to a fluoroelastomer. By the phrase grafted elastomer, volume graft or volume grafted elastomer, it is intended to define a substantially uniform integral interpenetrating network of a hybrid composition, wherein both the structure and the composition of the fluoroelastomer and polyorganosiloxane are substantially uniform when taken through different slices of the electrographic imaging member.

The phrase interpenetrating network is intended to define the addition polymerization matrix where the fluoroelastomer and polyorganosiloxane polymer strands are intertwined in one another.

The term hybrid composition is intended to define a volume grafted composition which is comprised of fluoroelastomer and polyorganosiloxane blocks randomly arranged.

The volume grafting according to the present invention is performed in two steps, the first involves the dehydrofluorination of the fluoroelastomer preferably using an amine. During this step hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer.

Fluoroelastomer examples include those described in detail in Lentz, U.S. Pat. No. 4,257,699, as well as those described in Eddy et al., U.S. Pat. No. 5,017,432 and Ferguson et al., U.S. Pat. No. 5,061,965, the disclosures of which are totally incorporated by reference. As described therein these fluoroelastomers, particularly from the class of copolymers and terpolymers of vinylidenefluoride hexafluoropropylene and tetrafluoroethylene, are known commercially under various designations as VITON A™, VITON E™, VITON E60C™, VITON E430™, VITON 910™, VITON GH™ and VITON GF™. The VITON™ designation is a Trademark of E. I. Dupont deNemours, Inc. Other commercially available materials include FLUOREL 2170™, FLUOREL 2174™, FLUOREL 2176™, FLUOREL 2177™ and FLUOREL LVS 76™, FLUOREL™ being a Trademark of 3M Company. Additional commercially available materials include AFLAS™ a poly(propylene-tetrafluoroethylene), FLUOREL II™ (LII900) a poly (propylene-tetrafluoroethylene-vinylidenefluoride) both also available from 3M Company as well as the TECNOFLON™ compositions identified as FOR-60KIR, FOR-LHF, NM, FOR-THF, FOR-TFS, TH, TN505 available from Montedison Specialty Chemical Co. Typically, these fluoroelastomers are cured with a nucleophilic addition curing system, such as a bisphenol crosslinking agent with an organophosphonium salt accelerator as described in further detail in the above referenced Lentz patent and in U.S. Pat. No. 5,017,432. In a particularly preferred embodiment, the fluoroelastomer is one having a relatively low quantity of vinylidenefluoride, such as in VITON GF™, available from E. I. Dupont deNemours, Inc. The VITON GF™ has 35 weight percent vinylidenefluoride, 34 weight percent hexafluoropropylene and 29 weight percent tetrafluoroethylene with 2 weight percent cure site monomer. It is generally cured with bisphenol phosphonium salt, or a conventional aliphatic peroxide curing agent.

Preferred examples of the polyorganosiloxane having functionality according to the present invention are of the formula:

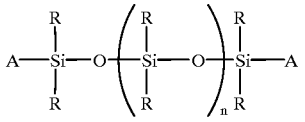

where R independently is an alkyl having for example from 1 to 24 carbon atoms, and preferably from 1 to 12 carbon atoms; alkenyl having for example from 2 to 24 carbon atoms, and preferably from 1 to 12 carbon atoms; or aryl having for example from 6 to 24 carbon atoms, and preferably from 6 to 18 carbon atoms, wherein the aryl group is optionally substituted with an amino, hydroxy, mercapto or an alkyl having for example from 1 to 24 carbon atoms, and preferably from 1 to 12 carbon atoms, or alkenyl group having from 2 to 24 carbon atoms, and preferably from 2 to 12 carbon atoms. In preferred embodiments, R is independently selected from methyl ethyl and phenyl. The functional group A may be an alkene or alkyne group having for example from 2 to 8 carbon atoms, preferably from 2 to 4 carbon atoms, optionally substituted with an alkyl having for example from 1 to 24 carbon atoms, and preferably from 1 to 12 carbon atoms, or aryl group having for example from 6 to 24 carbon atoms, and preferably from 6 to 18 carbon atoms. Functional group A can also be mono-, di-, or trialkoxysilane having 1 to 10, preferably 1 to 6, carbon atoms in each alkoxy group, hydroxy, or halogen. Preferred alkoxy groups include methoxy, ethoxy, and the like. Preferred halogens include chlorine, bromine and fluorine. In the above formula, n represents the number of segments and may be for example 2 to 350, and preferably from about 5 to about 100. In the above formula, typical R groups include methyl ethyl propyl octyl vinyl allylic crotnyl phenyl naphthyl and phenanthryl and typical substituted aryl groups are substituted in the ortho, meta and para positions with lower alkyl groups having less than 15 carbon atoms, and preferably from 1 to 10 carbon atoms. In a preferred embodiment, n is between 60 and 80. Typical alkene and alkenyl functional groups include vinyl acrylic, crotonic and acetenyl which may typically be substituted with methyl propyl, butyl benzyl and tolyl groups, and the like. The polyorganosiloxane may be present in any effective amount in the grafted elastomer, preferably from about 5 to about 50% by weight, and more preferably from about 10 to about 25% by weight based on the weight of the grafted elastomer. The polyorganosiloxane in the grafted elastomer differs from the formula disclosed herein for the functionally terminated polyorganosiloxane reactant, since the functional ends may have undergone reactions to bond the polyorganosiloxane to the fluoroelastomer.

The dehydrofluorinating agent which attacks the fluoroelastomer generating unsaturation is selected from the group of strong nucleophilic agents such as peroxides, hydrides, bases, oxides, etc. The preferred agents are selected from the group consisting of primary, secondary and tertiary, aliphatic and aromatic amines, where the aliphatic and aromatic groups have from 2 to 15 carbon atoms. It also includes aliphatic and aromatic diamines and triamines having from 2 to 15 carbon atoms where the aromatic groups may be benzene, toluene, naphthalene or anthracene etc. It is generally preferred for the aromatic diamines and triamines that the aromatic group be substituted in the ortho, meta and para positions. Typical substituents include lower alkylamino groups such as ethylamino, propylamino and butylamino with propylamino being preferred. Specific amine dehydrofluorinating agents include N-(2 aminoethyl-3-aminopropyl)-trimethoxy silane, 3-(N-strylmethyl-2-aminoethylamino) propyltrimethoxy silane hydrochloride and (aminoethylamino methyl) phenethyltrimethoxy silane.

Other adjuvants and fillers may be incorporated in the elastomer in accordance with the present invention as long as they do not affect the integrity of the fluoroelastomer. Such fillers normally encountered in the compounding of elastomers include coloring agents, reinforcing fillers, crosslinking agents, processing aids, accelerators and polymerization initiators. Following coating of the fluoroelastomer on the substrate, it is subjected to a step curing process at about 38° C. for 2 hours followed by 4 hours at 77° C. and 2 hours at 177° C.

The dehydrofluorinating agent generates double bonds by dehydrofluorination of the fluoroelastomer compound so that when the unsaturated functionally terminated polyorganosiloxane is added with the initiator, the polymerization of the siloxane is initiated. Typical free radical polymerization initiators for this purpose are benzoyl peroxide and azoisobutyronitrile, AIBN.

The charge accepting layer may be prepared by dissolving the fluoroelastomer in a typical solvent, such as methyl ethyl ketone, methyl isobutyl ketone and the like, followed by stirring for 15 to 60 minutes at 45–85° C. after which the polymerization initiator which is generally dissolved in an aromatic solvent, such as toluene is added with continued stirring for 5 to 25 minutes. Subsequently, the polyorganosiloxane is added with stirring for 30 minutes to 10 hours at a temperature of about 45 to 85° C. A nucleophilic curing agent such as, Viton Curative No. 50, which incorporates an accelerator, (a quarternary phosphonium salt or salts) and a crosslinking agent, bisphenol AF in a single curative system is added in a 3 to 7 percent solution predissolved in the fluoroelastomer compound. Optimally, the basic oxides, MgO and $Ca(OH)_2$ can be added in particulate form to the solution mixture. Providing the charge accepting layer on the substrate is most conveniently carried out by spraying, dipping or the like a solution of the homogeneous suspension of the fluoroelastomer and polyorganosiloxane to a level of film of about 12.5 to about 125 micrometers in thickness. When the desired thickness of coating is obtained, the coating is cured and thereby bonded to the substrate surface. A typical step curing process is heating for two hours at 93° C. followed by 2 hours at 149° C. followed by 2 hours at 177° C. followed by 2 hours at 208° C. and 16 hours at 232° C. After the coating has been dried, cured and cooled to room temperature, the charge accepting layer is rinsed in a bath of hydrocarbon solvent such as hexane or in a mixture composed of an equal volume of hexane and ISOPAR™ E. The ISOPAR™ E is available from Exxon Chemical Company. The electrographic imaging member is air dried to evaporate the hydrocarbon solvent. The surface energy of the resulting charge accepting layer is less than about 30 dynes/cm and preferably about 25 dynes/cm to insure good toner release during transfix to a recording sheet.

In embodiments, the charge accepting layer may contain one or more fillers to regulate the dielectric constant, thermal stability and conductivity, and the latent image charge retention properties through the various imaging process steps. These fillers may be present in an amount from about 1 to about 30% by weight of the charge accepting layer. Typical fillers include titanium dioxide, barium titanate, lead oxide, zinc oxide, copper oxide, aluminum oxide, barium nitride, tin oxide, antimony oxide and the like alone, in mixtures, or reacted together such as antimony doped tin oxide.

There may be an adhesive layer between the substrate layer and the charge accepting layer. The adhesive layer may have a thickness ranging for example from about 0.1 mil to about 3 mils, and more preferably from about 1 mil to about 2 mils. Examples of adhesives include: THIXON™ 403/404 and THIXON™ 330/301 both available from Morton International of Ohio; GE-2872-074™ available from the General Electric Company which is believed to be a copolymer of polyimide and siloxane; a silane coupling agent such as Union Carbide A-1100™ which is an amino functional siloxane; epoxy resins including bisphenol A epoxy resins available for example from Dow Chemical Company such as Dow TACTIX™ 740, Dow TACTIX™ 741, and Dow TACTIX™ 742, and the like, optionally with a crosslinker or curative such as DOW H41™ available from the Dow Chemical Company.

In embodiments of the present invention, there may be a charge blocking layer between the substrate layer and the charge accepting layer. The blocking layer can be made of any material which will retard or eliminate unwanted charge injection at the interface of the charge accepting layer and substrate. Suitable blocking layers can be made from materials including polyepoxides, polyimides, poly (amideimides), polybenzimidazoles, polyquinoxalines and other polyheterocyclic polymers. Preferably, the material forming the blocking layer also has adhesive properties for bonding the charge accepting layer to the substrate. Particularly preferred blocking layer materials include polyepoxides, polyimides and poly(amideimides) such as those sold under the following tradenames by the following companies: MATRIMIDE™ 5292 and 5218 (polyimide resin) from Ciba-Geigy; ARALDITE™ 471 x 75 (cured with HY283 amide hardener), ARALDITE™ PT810, ARALDITE™ MY720, and ARALIDTE™ EPN 1138/1138 A-84 (multifunctional epoxy and epoxy novolak resins) from Ciba-Geigy; ECN 1235, 1273 and 1299 (epoxy cresol novolak resins) from Ciba-Geigy; TORLON™ AI-10 (poly (amideimide) resin) from Amoco; THIXON™ 300/301 from Whittaker Corp.; TACTIX™ (tris(hydroxyphenyl) methane-based epoxy resins, oxazolidenone modified tris (hydroxyphenyl) methane-based epoxy resins, and multi-functional epoxy-based novolak resins) from Dow Chemical; and EYMYD™ resin L-20N (polyimide resin) from Ethyl Corporation, and the like.

Suitable substrates are also known in the art. Preferred substrate materials include polyimides, poly(amideimides), polyetherether ketones, polyphenylene sulfides, and liquid crystal polymers, alone or in mixtures, which preferably withstand curing temperatures in excess of 200° C. Particularly preferred substrate materials include metalized polyimides (such as aluminized KAPTON™ (a polyimide film available from DuPont), titanized KAPTON™ and copperized KAPTON™), aluminum, nickel copper and stainless steel. Alternatively, the substrate can be made of a polymer film filled with conductive materials such as carbon black, metal flakes or metal fibers, such as carbon black filled KAPTON™ or UPILEX™ (UPILEX™ is a polyimide film available from ICI America). The electrographic imaging member may be in the form of a hollow cylinder having open ends or a flexible belt.

Alternately, the substrate may be coated with a conductive elastomer which may also function as a ground plane and contribute to the overall compliancy of the electrographic imaging member to allow greater conformity to textured paper for complete image transfer. The conductive elastomer may be a fluoroelastomer described herein containing a dispersed conductive filler such as carbon black, graphite, metal powders, tin oxide, including the fillers described in U.S. Pat. No. 5,298,956, the disclosure of which is totally incorporated herein by reference.

The thicknesses of the charge accepting layer, substrate layer and blocking layer will depend on numerous factors including the desired electrical characteristics of the layers and economic factors. Suitable thicknesses for the substrate depend on its preferred usage as flexible or rigid. Typically flexible layers are from about 10 to about 250 micrometers and rigid substrate layers from about 250 micrometers to about 5 mm. Blocking layer thicknesses are typically from about 0.01 micrometer to about 12.5 micrometers and are preferably from about 1 to about 4 micrometers. The charge acceptor layer thickness is typically from about 4 to about 350 micrometers and is preferably from about 4 to about 120 micrometers.

Illustrated in FIG. 1 is a schematic representation of one possible multicolor printing machine configuration suitable for an ionographic printing process Electrographic imaging member 20 is employed as an electroreceptor. It is preferred that electrographic imaging member 20 is composed of a two layer structure which can be optionally mounted onto a rigid member 5. The substrate layer 6 has a thickness between about 0.1 mm and about 1.0 mm and a resistivity from about $10^2$ ohm-cm to about $10^{11}$ ohm-cm at temperatures between about 50 to about 200° C. A charge accepting top layer 8 has a thickness less than about 100 micrometers, a dielectric constant between about 2.3 and about 20, and a resistivity between about $10^{12}$ ohm-cm and $10^{18}$ ohm-cm at temperatures between about 50 to about 200° C. The top layer also has an adhesive release surface. Also, it is preferred that the charge accepting layer has a hardness between about 45 durometer and about 90. The charge accepting layer and the substrate may be laminated together. An advantageous feature of the electrographic imaging member as described above is that the combined thickness is great enough to allow conformity to texture paper or other image receiver, while the charge accepting top layer has a dielectric equivalent thickness of about 9 to about 20 micrometers, giving a unit area capacitance of about $7\times10^{11}$ S/cm$^2$ or about 70 pS/cm$^2$. This allows a latent image voltage contrast of no more than about 350 volts, for a charge density of at least about 25 nC/cm$^2$.

Electrographic imaging member 20 rotates in the direction indicated by arrow 3. Electrographic imaging member 20 receives a first latent image to be developed with a first color from ionographic or ionic projection writing head 7, which latent image is then developed with a first developer at one of a plurality of development stations 9*a,* 9*b,* 9*c,* and 9*d;* FIG. 1 illustrates development with station 9*a* engaged. Development stations 9*a,* 9*b,* 9*c,* and 9*d* employ a noninteractive marking technique to deposit marking particles on the surface of electrographic imaging member 20. The marking particles are transformed into a tackified or molten state by heat which is applied to electrographic imaging member 20 internally. Electrographic imaging member 20 includes a plurality of heating elements 32*a,* 32*b,* 32*c,* and 32*d* which not only heats the internal wall of the electrographic imaging member in the region, but generally maintains the outer wall of member 20 at a temperature sufficient to cause the marking particles present on the surface to melt. Preferably, heat controller 21 keeps electrographic imaging member temperature between the temperatures of about 50 to about 200° C. An advantageous feature of maintaining the temperature from about 50 to about 200° C. is that it enables the development of a second latent image without disturbing the previous developed latent image thereby producing color images with uniform, low noise transfer and low paper curl. It is believe that the developed latent image composed of loose marking particles quickly tackifies to the electrographic imaging member. As the marking particles tackified, the developed latent image flow into greater contact and higher capacitance with the electrographic imaging member, and the charges on the marking particles relax. This, in turn, reduces contributions to blooming by previous developed images, and also reduces tendency of loose toner to shift under high lateral electrostatic fields at the boundaries of the latent image for the next color. The temperature of the electrographic imaging member is measured at the outer surface using one or more thermal couples. A toner cleaning station may be employed even though toner transfer is substantially complete, Le., wiper blades, absorbant web, sticky roller, etc. Also any remaining electrical charge on the electroreceptor may be neutalized using an AC corotron or other device before another image is produced. This is important for color prints.

When images of more than one color are desired, the imaging member again moves past ionic projection writing head 7, at which point another latent image is formed on top of the first developed image, and the latent image moves past development stations 9, where it is developed with a second marking particle of a color different from that of the first developer at, for example, development station 9*b*. The second marking particle quickly tackifies to the previous developed latent image. The process is repeated, with the subsequent latent images being developed at development stations 9*c* and 9*d,* until the final full color image has been formed. The full color image moves to transfix to a recording sheet.

At transfix nip 34, the liquefied marking particles of the full color image are forced, by a normal force N applied through backup pressure roll 36, into contact with the surface of recording sheet 26. As the recording sheet passes through the transfix nip the tackified marking particles wet the surface of the recording sheet, and due to greater attractive forces between the paper and the tackified particles, as compared to the attraction between the tackified particles and the liquid-phobic surface of member 20, the tackified particles are completely transferred to the recording sheet. Furthermore, the full color image image transferred to recording sheet 26 in a tackified state becomes permanent once the full color image advances past transfix nip and is allowed to cool.

In recapitulation, the present invention is a method and apparatus for printing which employs a heated electrographic imaging member. The electrographic imaging member first acts as a receptor for marking particles representing an image, whereby the marking particles may be deposited directly or indirectly on the member. The member is then exposed, via an internal heat source, to an elevated temperature sufficient to cause the melting and coalescing of the marking particles. Subsequently, the electrographic imaging member is advanced so as to place the tackified marking particles present on the outer surface thereof into intimate contact with the surface of a recording sheet. The present invention takes advantage of the dimensional stability of the electrographic imaging member to provide a uniform image deposition stage, resulting in a controlled image transfer gap and better image registration. Further advantages include reduced heating of the recording sheet as a result of the toner or marking particles being pre-melted, as well as the elimination of electrostatic transfer of charged particles to a recording sheet. It is, therefore, apparent that there has been provided, in accordance with the present invention, a method and apparatus for producing a transferable image directly on a fuser-like electrographic imaging member.

The present invention describes thermally stable materials for an electrographic imaging member which retains an image charge at an elevated temperature, where the imaging member at elevated temperature has toner releasing properties and substantially fuses toner to a recording sheet. Toner transfer from the imaging member to recording sheet is direct minimizing toner disturbance for greater resolution images. The imaging member may be heated prior to charging. Another advantage is that the electrographic imaging member does not need to be cooled down between any of the xerographic process steps. The developer apparatus includes marking material which is either a liquid developer (i.e., liquid carrier and toner particles) or a dry developer (i.e., toner particles optionally with carrier particles).

The volume graft electroreceptor material prepared as described in U.S. Pat. No. 5,338,587 contains a silicone oil by-product (contaminant) of the reaction which blooms to the surface causing charge decay when the electroreceptor is heated above about 35 degrees C. The contaminating by-product residue of the volume graft synthesis of U.S. Pat. No. 5,338,587 may be further removed by washing the dried and cured electrographic imaging member coating with a hydrocarbon such as hexane. Removing the contaminating by-products permits the volume graft charge accepting layer to be heated to a temperature up to at least about 200 degrees C. without total loss of the electric charge.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

The ends of a 75 micrometer thick sheet of stainless steel about 390 mm wide was electron beam welded together to form an endless sleeve of about 275 mm inside diameter. The inside and outer surfaces around the weld area of the seamed sleeve was polished so that the seam height was less than about 4 micrometers. A polyorganosiloxane elastomer composition, type S-1280 part A & B available from Castall, Inc., East Weymouth, Mass. was used to coat the sleeve. The mix ratio was 10 parts A to 1 part B. The composition was dip coated onto the welded stainless steel sleeve to produce a dry coating thickness on the outside surface of about 75 micrometers. The coating was air dried for about 30 minutes to flash-off coating solvents then cured at about 120 degrees C. for about 1 hour. The bulk electrical resistivity of the electrographic member coating was about $10^{15}$ ohm-cm and the dielectric constant at 25 degrees C., 100,000 cycles, was about 3.8. The coated sleeve was mounted on a drum and tested in a laboratory fixture generally configured as indicated in FIG. 1. The temperature of the electrographic member at the outer surface was raised to maintain a temperature of about 125 degrees C. The electrographic member was sequentially image-wise charged to about a negative 275 volts and developed with a non-interactive marking technique using a developer unit as described in U.S. Pat. No. 5,172,170, the disclosure of which is totally incorporated herein by reference. The toner developed on the electrographic imaging member melted and was transfixed to a recording sheet. Toner transfer was substantially complete. The electrographic member however was cleaned using a wiper blade. Any latent image charge remaining on the electrographic member was neuralized with an AC corotron and image-wise recharged to produced several more prints. The toner was well fixed on the recording sheet.

EXAMPLE 2

A volume graft elastomer was prepared by dissolving 250 grams of Viton GF in 2.5 liters of methyl ethyl ketone (MEK) by stirring at room temperature. This was performed in a 4 liter plastic flask using a moving base shaker for about two hours to accomplish the dissolution. The solution produced was transferred to a 5 liter Erlenmeyer glass flask and 25 milliliters of the dehydrofluorinating amine agent, 3-(N-styrylmethyl-2-amino-ethylamino) propyltrimethoxysilane hydrochloride (S-1590), available from Huls America Inc., Piscataway, N.J., was added. The contents of the flask were then stirred using a mechanical stirrer while maintaining the temperature between 55 and 60 degrees C. After stirring for 30 minutes, 50 milliliters of 100 centistoke vinyl terminated polysiloxane (PS-441) also available from Huls America Inc., was added and stirring was continued for another ten minutes. A solution of 10 grams of benzoyl peroxide in a 100 milliliter mixture of toluene and MEK (80:20) was then added. The stirring was continued while heating the contents of the flask at about 55 degrees C. for another 2 hours. During this time, the color of the solution turned light yellow, and the solution was then poured into an open tray. The tray was left in a fume hood for 16 hours. The resulting yellow rubbery mass remaining after air evaporation of the solvent was then cut into small pieces with a scissor. Thereafter, 54.5 grams of the prepared silicone grafted fluoroelastomer, together with 495 grams of methyl isobutyl ketone (MIBK), 1.1 grams of magnesium oxide and 0.55 gram of calcium hydroxide were added to ajar containing ceramic balls followed by roll milling for about 20 hours until a fine 3 to 5 micrometers in diameter particle size of the fillers in dispersion was obtained. Subsequently, 2.5 grams of DuPont Viton curative VC-50 catalyst crosslinker in 22.5 parts MEK were added to the above dispersion, shaken for about 15 minutes and the solids content reduced to about 10 percent by the addition of MIBK. Following hand mixing, the mixture was ready for coating.

EXAMPLE 3

Electrographic imaging member coatings were produced using the volume graft composition of Example 2 as follows. Several 75 micrometer thick sheets of conductive polyimide film with a bulk electrical resistivity of about $10^6$ ohm-cm were coated with a conductive base coating comprising part A of 100 parts of Viton GF, 10 parts of Vulcan XC-72 conductive carbon black available from Cabot Corporation, Billerica, Mass., 15 parts MgO in MIBK to a 15 percent solids by weight mixture, and part B of 5 parts of Viton Curative VC-50 and 28.3 parts of MIBK. Part B was added to part A and roll milled for 45 minutes, then spray coated onto the conductive polyimide film to yield a dried and cured coating thickness of about 125 micrometers. The drying and cure cycle was 2 hours at 35 degrees C., 4 hours at 77 degrees C., 2 hours at 177 degrees C. and 4 hours at 225 degrees C. The bulk electrical resistivity of the coated layer was about $10^7$ ohm-cm. The volume graft coating composition of Example 2 above was spray overcoated onto two of the conductive Viton coated polyimide sheets prepared above to a dry coated thickness of about 25 micrometers. The coatings were first air dried for several hours at 35 degrees C. then cured for 2 hours at 260 degrees C. One of the volume graft overcoated electrographic imaging members identified as Coating 3-A, cooled to room temperature, was put into a tray containing a hydrocarbon solvent mixture composed of an equal volume of hexane and ISOPAR™ E, enough to cover the coating. Coating 3-A was swished through the hydrocarbon solvent wash several times, then swished again in another tray containing the same hydrocarbon solvent mixture. The coating was air dried for 15 minutes then put in an oven for 1 hour. The second electrographic imaging member identified as Coating 3-B was not treated with the hydrocarbon solvent. The electrographic imaging members were characterized for charge acceptance, charge decay at various temperatures. The Coatings 3-A and 3-B were placed on a hot plate and equilibrated to the operating set temperature. The samples (Coatings 3-A and 3-B) were then corona charged either positive or negative after reaching the set temperature and the voltages retained by the electrographic coatings were measured after 5, 10 and 15 seconds by an electrometer positioned over the samples. The results in Table I show that the hydrocarbon solvent washed volume graft overcoated electrographic imaging member (Coating 3-A) accepts and holds both a positive and negative potential when heated to 150 degrees C. for more than 15 seconds. No voltage of either a negative or positive potential was measured on the electographic imaging member using the non-washed volume graft composition (Coating 3-B) when heated over 23 degrees C.

TABLE I

Voltage Measured on Electrographic Imaging Member

| | Temperature | | | |
|---|---|---|---|---|
| Coating | 23° C. | 100° C. | 150° C. | Time |
| 3-A | 800 v | 700 v | 200 v | after 5 seconds |
| | −800 v | −750 v | −350 v | after 5 seconds |
| | 750 v | 440 v | 150 v | after 10 seconds |
| | −770 v | −600 v | −220 v | after 10 seconds |
| | 750 v | 325 v | 55 v | after 15 seconds |
| | −740 v | −510 v | −110 v | after 15 seconds |
| 3-B | 800 v | 0 | 0 | after 5 seconds |
| | −780 v | 0 | 0 | after 5 seconds |
| | 770 v | 0 | 0 | after 10 seconds |
| | −730 v | 0 | 0 | after 10 seconds |

Other modifications of the present invention may occur to those skilled in the art based upon a reading of the present disclosure and these modifications are intended to be included within the scope of the present invention.

We claim:

1. A printing machine comprising:

(a) an electrographic imaging member including a substrate layer and a charge accepting layer, wherein the charge accepting layer is selected from the group consisting of a silicone elastomer and a grafted elastomer composed of a polyorganosiloxane bonded to a fluoroelastomer, wherein the charge accepting layer further includes electrical property regulating filler material dispersed throughout the thickness of the charge accepting layer;

(b) latent image generating apparatus for recording an electrostatic latent image on the imaging member;

(c) developer apparatus for depositing marking material on the imaging member to produce a marking material image;

(d) a heating device for heating the imaging member so as to form a tackified marking material image thereon; and (e) transfer apparatus for transfering the tackified marking material image from the imaging member to a recording sheet.

2. The printing machine of claim 1, further comprising a heat controller, coupled to the heating device, for maintaining the imaging member at a temperature ranging from about 50 to about 200° C.

3. The printing machine of claim 1, wherein the substrate layer has a resistivity ranging from about $10^2$ to about $10^{11}$ ohm-cm at a temperature ranging from about 50 to about 200° C.

4. The printing machine of claim 1, wherein the charge accepting layer has a dielectric constant ranging from about 2.3 to about 20 and a resistivity ranging from about $10^{12}$ to about $10^{18}$ ohm-cm at a temperature ranging from about 50 to about 200° C.

5. The printing machine of claim 1, wherein the charge accepting layer has a hardness ranging from about 45 to about 90 durometer.

6. The printing machine of claim 1, wherein the substrate layer has a thickness ranging from about 0.1 mm to about 1 mm and the charge accepting layer has a thickness ranging from about 10 to about 100 micrometers.

7. The printing machine of claim 1, wherein the charge accepting layer is the silicone elastomer.

8. The printing machine of claim 1, wherein the silicone elastomer is polydimethylsiloxane.

9. The printing machine of claim 1, wherein the charge accepting layer is the grafted elastomer.

10. The printing machine of claim 1, wherein the polyorganosiloxane is polydimethylorganosiloxane.

11. The printing machine of claim 1, wherein the surface energy of the charge accepting layer is less than about 30 dynes/cm.

12. The printing machine of claim 1, wherein the electrical property regulating filler material is present in an amount ranging from about 1% to about 30% by weight based on the weight of the charge accepting layer.

13. The printing machine of claim 1, wherein the electrical property regulating filler material is selected from the group consisting of: titanium dioxide, barium titanate, lead oxide, zinc oxide, copper oxide, aluminum oxide, barium nitride, tin oxide, antimony oxide, and antimony doped tin oxide.

* * * * *